US010364769B2

(12) United States Patent
Faied et al.

(10) Patent No.: US 10,364,769 B2
(45) Date of Patent: Jul. 30, 2019

(54) SYSTEMS AND METHODS FOR DETECTING GASOLINE DIRECT INJECTION FUEL INJECTOR COMBUSTION SEAL LEAKS

(71) Applicants: Louai A Faied, Rochester Hills, MI (US); Alan G Falkowski, Lake Orion, MI (US)

(72) Inventors: Louai A Faied, Rochester Hills, MI (US); Alan G Falkowski, Lake Orion, MI (US)

(73) Assignee: FCA US LLC, Auburn Hills, MI (US)

( * ) Notice: Subject to any disclaimer, the term of this patent is extended or adjusted under 35 U.S.C. 154(b) by 92 days.

(21) Appl. No.: 15/806,499

(22) Filed: Nov. 8, 2017

(65) Prior Publication Data

US 2019/0136782 A1 May 9, 2019

(51) Int. Cl.

| | |
|---|---|
| ***F02D 41/00*** | (2006.01) |
| ***F02D 41/30*** | (2006.01) |
| ***F02D 41/22*** | (2006.01) |
| ***F02D 41/38*** | (2006.01) |

(52) U.S. Cl.

CPC ..... *F02D 41/22* (2013.01); *F02D 41/0087* (2013.01); *F02D 41/3076* (2013.01); *F02D 41/3809* (2013.01); *F02D 2041/225* (2013.01); *F02D 2041/389* (2013.01); *F02D 2200/0602* (2013.01)

(58) Field of Classification Search

CPC ..... F02D 41/00; F02D 41/0087; F02D 41/22; F02D 41/30; F02D 41/3076; F02D 41/38; F02D 41/3809; F02M 21/02; F02M 21/0245; F02M 21/0269; F02M 21/0272; F02M 21/0275; F02M 21/0281; F02M 61/14; F02M 69/54; G06F 19/00

USPC ..... 123/470–472, 479, 480, 486; 701/101–107, 114; 73/114.45; 277/235 A, 236, 592, 594

See application file for complete search history.

(56) References Cited

U.S. PATENT DOCUMENTS

| | | | | |
|---|---|---|---|---|
| 5,247,918 A | | 9/1993 | Wakeman | |
| 6,021,762 A | * | 2/2000 | Zeidler | F02M 39/00 123/470 |
| 7,968,167 B2 | * | 6/2011 | Qi | F02M 61/14 123/467 |

(Continued)

*Primary Examiner* — John Kwon
*Assistant Examiner* — Johnny H Hoang
(74) *Attorney, Agent, or Firm* — Ralph E. Smith

(57) ABSTRACT

Systems and methods utilize a controller configured to perform a diagnostic routine for a combustion seal provided between a gasoline direct injection (GDI) fuel injector and a combustion chamber of a cylinder of a GDI engine. The diagnostic routine comprises determining one of (i) a period for the injector coil current to reach a peak current and (ii) a resistance of the injector coil while the injector coil current is saturated, determining whether the determined period or the determined injector coil resistance is greater than a respective threshold indicative of a predetermined temperature of the injector coil, and when the determined period or the determined injector coil resistance is greater than its respective threshold, detecting a combustion seal leak fault. Based on the combustion seal leak fault, the controller may modify operation of the engine to prevent potential heat damage to the engine.

20 Claims, 5 Drawing Sheets

(56) References Cited

U.S. PATENT DOCUMENTS

| | | | | |
|---|---|---|---|---|
| 2002/0152985 | A1* | 10/2002 | Wolff | F02D 19/0631 123/305 |
| 2008/0302176 | A1* | 12/2008 | Friedl | F02D 41/042 73/114.45 |
| 2009/0250038 | A1 | 10/2009 | Xu et al. | |
| 2011/0000464 | A1 | 1/2011 | Kannan et al. | |
| 2012/0180762 | A1* | 7/2012 | Casasso | F02D 41/20 123/472 |
| 2013/0160741 | A1* | 6/2013 | Sommars | F02M 43/04 123/456 |
| 2015/0292440 | A1* | 10/2015 | Hamada | F02M 21/0272 123/294 |

* cited by examiner

300

320

Test Current Waveform 308
Normal Current Waveform 304
$I_{hold\ eff}$
$I_{A\ eff}$
$I_A$
$I_{Boost}$
current [A]
time [ms]
$t_1$
$t_2$
$U_{Boost}$
voltage [V]
$U_{Batt}$
$-U_{discharge}$
$t_{boost}$
time [ms]

SYSTEMS AND METHODS FOR DETECTING GASOLINE DIRECT INJECTION FUEL INJECTOR COMBUSTION SEAL LEAKS

FIELD

The present application generally relates to fuel injection systems and, more particularly, to systems and methods for detecting gasoline direct injection (GDI) fuel injector combustion seal leaks.

BACKGROUND

A gasoline direct injection (GDI) engine draws air into a plurality of cylinders and injects gasoline directly into combustion chambers of the cylinders using GDI fuel injectors. The air/fuel mixture is compressed by pistons and ignited by spark generated by spark plugs. The combustion of the compressed air/fuel mixture drives the pistons to generate torque at a crankshaft. Exhaust gas resulting from combustion is then expelled from the cylinders into an exhaust treatment system. The GDI fuel injectors are typically arranged in bored cavities in a cylinder head portion of the engine. A combustion seal is provided between each GDI injector and its respective combustion chamber. If these seals leak, some of the exhaust gas escapes from the combustion chamber past the combustion seal. The high temperature of the exhaust gas could potentially damage the GDI fuel injector, such as melting of molded plastic. Conventional techniques, such as knock monitoring, are unable to detect the combustion seal failure. Accordingly, while known fuel injection systems work well for their intended purpose, there remains a need for improvement in the relevant art.

SUMMARY

According to one example aspect of the invention, a system for a vehicle having a gasoline direct injection (GDI) engine is presented. In one exemplary implementation, the system comprises: an injector coil driver configured to supply a current to an injector coil of a GDI fuel injector of the engine, and a controller configured to: perform a diagnostic routine for a combustion seal provided between the GDI fuel injector and a combustion chamber of a cylinder of the engine, the diagnostic routine comprising: determining one of (i) a period for the injector coil current to reach a peak current and (ii) a resistance of the injector coil while the injector coil current is saturated, determining whether the determined period or the determined injector coil resistance is greater than a respective threshold indicative of a predetermined temperature of the injector coil, and when the determined period or the determined injector coil resistance is greater than its respective threshold, detecting a combustion seal leak fault; and based on the combustion seal leak fault, modifying operation of the engine to prevent potential heat damage to the engine.

In some implementations, the diagnostic routine is a non-intrusive diagnostic routine that continuously determines the period for the injector coil to reach the peak current while the engine is running. In some implementations, the controller is configured to modify operation of the engine by commanding a limp home mode where torque output of the engine is reduced. In some implementations, the controller is configured to modify operation of the engine by disabling the cylinder associated with the combustion seal leak fault. In some implementations, the controller is configured to modify operation of the engine by limiting power output of the cylinder associated with the combustion seal leak fault. In some implementations, the predetermined temperature is less than a temperature at which a plastic portion of the GDI engine melts, wherein the plastic portion of the GDI engine is one of a body of the GDI fuel injector, a valve cover, and a wire harness.

In some implementations, the diagnostic routine is an intrusive diagnostic routine that is executed in response to detecting a misfire event. In some implementations, the intrusive diagnostic routine comprises: detecting the misfire event of the engine; and in response to detecting the misfire event of the engine, commanding the injector coil driver to switch from supplying a normal current waveform to supplying a different test current waveform that causes the injector coil current to saturate. In some implementations, the test current waveform allows the injector coil current to saturate to allow for steady-state measurement of its current and voltage by the controller, and wherein the controller determines the resistance of the injector coil based on its measured current and voltage. In some implementations, the controller is further configured to detect a set of preconditions before performing the intrusive diagnostic routine, the set of preconditions including fuel injection duration and fuel rail pressure being greater than respective minimum thresholds.

According to another example aspect of the invention, a method for diagnosing a leak of a combustion seal provided between a gasoline direct injection (GDI) fuel injector and a combustion chamber of a cylinder of a GDI engine of a vehicle is presented. In one exemplary implementation, the method comprises: controlling, by a controller of the engine, an injector coil driver that is configured to supply a current to an injector coil of a GDI fuel injector of the engine; performing, by the controller, a diagnostic routine for a combustion seal provided between the GDI fuel injector and a combustion chamber of a cylinder of the engine, the diagnostic routine comprising: determining one of (i) a period for the injector coil current to reach a peak current and (ii) a resistance of the injector coil while the injector coil current is saturated, determining whether the determined period or the determined injector coil resistance is greater than a respective threshold indicative of a predetermined temperature of the injector coil, and when the determined period or the determined injector coil resistance is greater than its respective threshold, detecting a combustion seal leak fault; and based on the combustion seal leak fault, modifying, by the controller, operation of the engine to prevent potential heat damage to the engine.

In some implementations, the diagnostic routine is a non-intrusive diagnostic routine that continuously determines the period for the injector coil to reach the peak current while the engine is running. In some implementations, modifying operation of the engine includes commanding, by the controller, a limp home mode where torque output of the engine is reduced. In some implementations, modifying operation of the engine includes disabling, by the controller, the cylinder associated with the combustion seal leak fault. In some implementations, modifying operation of the engine includes limiting, by the controller, power output of the cylinder associated with the combustion seal leak fault. In some implementations, the predetermined temperature is less than a temperature at which a plastic portion of the GDI engine melts, wherein the plastic portion of the GDI engine is one of a body of the GDI fuel injector, a valve cover, and a wire harness.

In some implementations, the diagnostic routine is an intrusive diagnostic routine that is executed in response to detecting a misfire event. In some implementations, the intrusive diagnostic routine comprises: detecting, by the controller, the misfire event of the engine; and in response to detecting the misfire event of the engine, commanding, by the controller, the injector coil driver to switch from supplying a normal current waveform to supplying a different test current waveform that causes the injector coil current to saturate. In some implementations, the test current waveform allows the injector coil current to saturate to allow for steady-state measurement of its current and voltage by the controller, and wherein the controller determines the resistance of the injector coil based on its measured current and voltage. In some implementations, the method further comprises detecting, by the controller, a set of preconditions before performing the intrusive diagnostic routine, the set of preconditions including fuel injection duration and fuel rail pressure being greater than respective minimum thresholds.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

As previously mentioned, conventional techniques are unable to detect combustion seal failures for gasoline direct injection (GDI) fuel injectors. If undetected, these combustion seal failures could potentially result in damage to the GDI fuel injectors or other engine components (e.g., melting of plastic). In addition, the combustion seal leak could cause a pressure or pumping loss and thus decreased engine performance/efficiency. Another potential solution would be to attach temperature sensors or thermocouples to the fuel injector, but this would drastically increase costs. Accordingly, systems and methods are presented for detecting GDI fuel injector combustion seal leaks without the addition of extra sensors. These techniques monitor the resistance or inductance (current rise rate) of the injector coil, both of which increase with the temperature of the injector coil. Thus, when a combustion seal leak occurs, the exhaust gas that escapes the cylinder will increase the temperature and the resistance/inductance of the injector coil. Remedial action can then be taken to modify engine operation to prevent potential heat damage to the engine.

Figure 1:
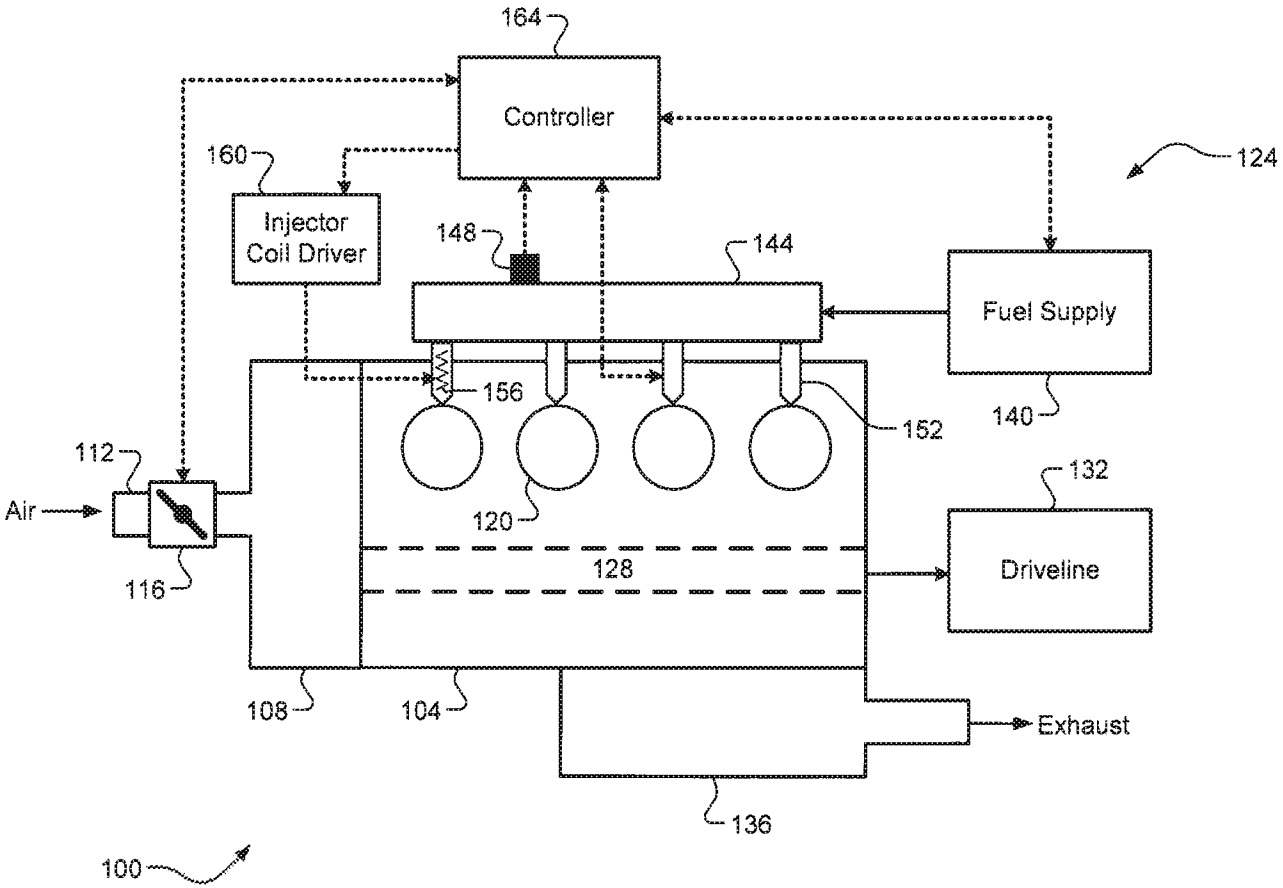
FIG. 1 is a diagram of an example vehicle including a gasoline direct injection (GDI) engine according to the principles of the present disclosure.

Referring now to FIG. 1, a diagram of an example vehicle 100 is illustrated. The vehicle 100 includes a GDI engine 104 that draws air into an intake manifold 108 through an induction system 112 that is regulated by a throttle valve 116. The air in the intake manifold 108 is distributed to a plurality of cylinders 120 and combined with gasoline from a fuel system 124 to form an air/fuel mixture. While four cylinders 120 are shown in an in-line configuration, it will be appreciated that other numbers and configurations of cylinders could be utilized (e.g., six cylinders in a two bank V-configuration). The air/fuel mixture is compressed by pistons (not shown) and ignited by spark from spark plugs (not shown). The combustion of the compressed air/fuel mixture drives the pistons, which generate torque at a crankshaft 128. The drive torque is transferred to a driveline 132, e.g., via a transmission (not shown). Exhaust gas resulting from combustion is expelled from the cylinders 120 into an exhaust system 136.

The fuel system 124 comprises a fuel supply 140 that provides pressurized fuel to a fuel rail 144. Example components of the fuel supply 140 are a fuel tank and a fuel pump. A fuel rail pressure sensor 148 measures a pressure of the fuel in the fuel rail. Fuel injectors 152 are configured to inject the pressurized fuel from the fuel rail 144 into respective cylinders 120. Each fuel injector 152 includes a fuel injector coil 156 that is provided a current to actuate its respective fuel injector 152. This current is provided by respective injector coil drivers 160. For example, the injector coil drivers 160 may be powered by a battery (not shown). A controller 164 controls operation of the engine 104, including, but not limited to, controlling the throttle valve 116, controlling the spark plugs (not shown), controlling the fuel supply 140 (e.g., the fuel pump), and controlling the injector coil drivers 160. It will be appreciated that the injector coil drivers 160 could be implemented as part of the controller 164. The controller 164 is also configured to obtain the measured fuel rail pressure and parameters of the injector coils 156 (voltage, current, etc.).

Figure 2:
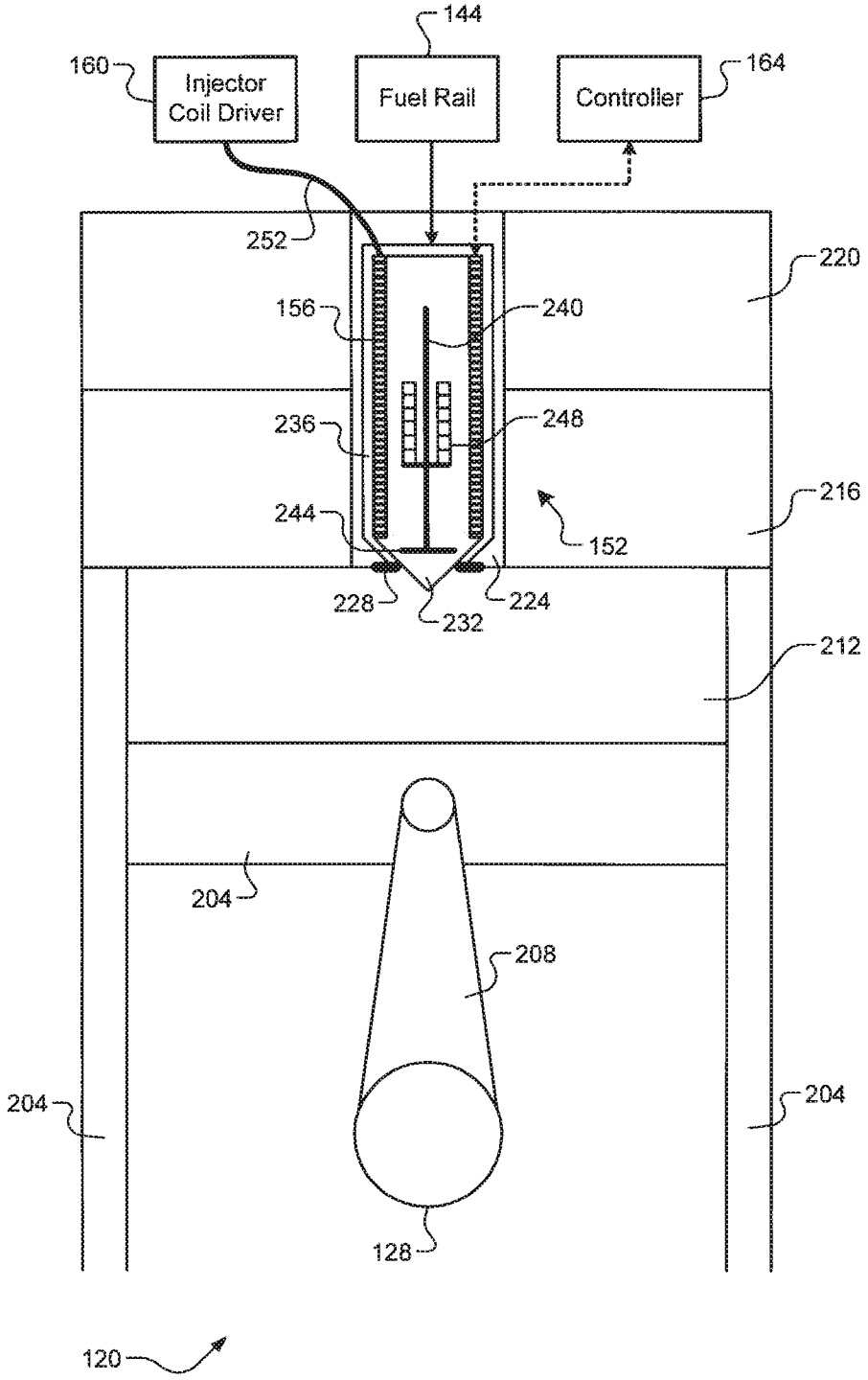
FIG. 2 is a cross-sectional diagram of a portion of the GDI engine according to the principles of the present disclosure.

Referring now to FIG. 2, a cross-sectional view of a portion of the engine 104 is illustrated. The cylinder 120 includes a piston 200 disposed between a wall 204 of the cylinder 120. The piston 200 is coupled to the crankshaft 128 via a connecting rod 208. A combustion chamber 212 of the cylinder 120 is defined between the piston 200, the cylinder wall 204, and a cylinder head 216 of the engine 104. A valve cover 220 is also disposed above the cylinder head 216. The fuel injector 152 is disposed within a bored out cavity 224 in the cylinder head 216. A combustion seal 228 is provided to prevent fluid flow between the combustion chamber 212 and the fuel injector cavity 224. For example, the combustion seal 228 could be a radial seal provided around a tip 232 of the fuel injector 152 as shown. It will be appreciated that any suitable combustion seal 228 could be implemented. One example material used for the combustion seal 228 is polytetrafluoroethylene (PTFE).

The fuel injector 152 comprises a housing or fuel injector body 236 that houses a magnetic spindle 240 coupled to a plunger 244. The spindle/plunger 240/244 are spring-loaded by a spring 248 such that the plunger 244 is typically forced downward to close the fuel injector 152. When a current is provided by the injector coil driver 160 to the injector coil 156 (via a wire harness 252), a magnetic field is created that draws the magnetic spindle 240 upward, thereby opening the fuel injector 152. When open, pressurized fuel is able to flow from the fuel rail 144 through the fuel injector 152 and into the combustion chamber 212. The controller 164 is also configured to obtain parameters of the injector coil 156 (voltage, current, etc.), e.g., using sensors (not shown). It will be appreciated that FIG. 2 merely illustrates one type of electronic fuel injector 152 and that other suitable electronic fuel injector configurations could be utilized.

When the air/fuel mixture combusts, exhaust gas is produced within the combustion chamber 212. This exhaust gas is typically expelled from the cylinder via an exhaust port/valve (not shown) and into the exhaust system 136. Similarly, the air is initially drawn into the cylinder 120 via an intake port/valve (not shown). When the combustion seal 228 malfunctions or leaks, exhaust gas is able to flow from the combustion chamber 212 and into the fuel injector cavity 224. The high temperatures of the exhaust gas could potentially cause heat damage to plastic components of the engine 104. Non-limiting examples of these components include the fuel injector body 236, the valve cover 220, and the wire harness 252. It will be appreciated that other plastic and non-plastic components could also potentially be susceptible to heat damage caused by the exhaust gas. Potential remedial actions to prevent heat damage to the engine 104 include, but are not limited to, commanding a limp-home mode (e.g., reducing engine torque output), disabling the affected cylinder 120 (e.g., disabling its fuel injector 152 and potentially closing its valves), and limiting the power output of the affected cylinder 120 (e.g., by reducing a provided air/fuel charge).

Figures 3A, 3B:
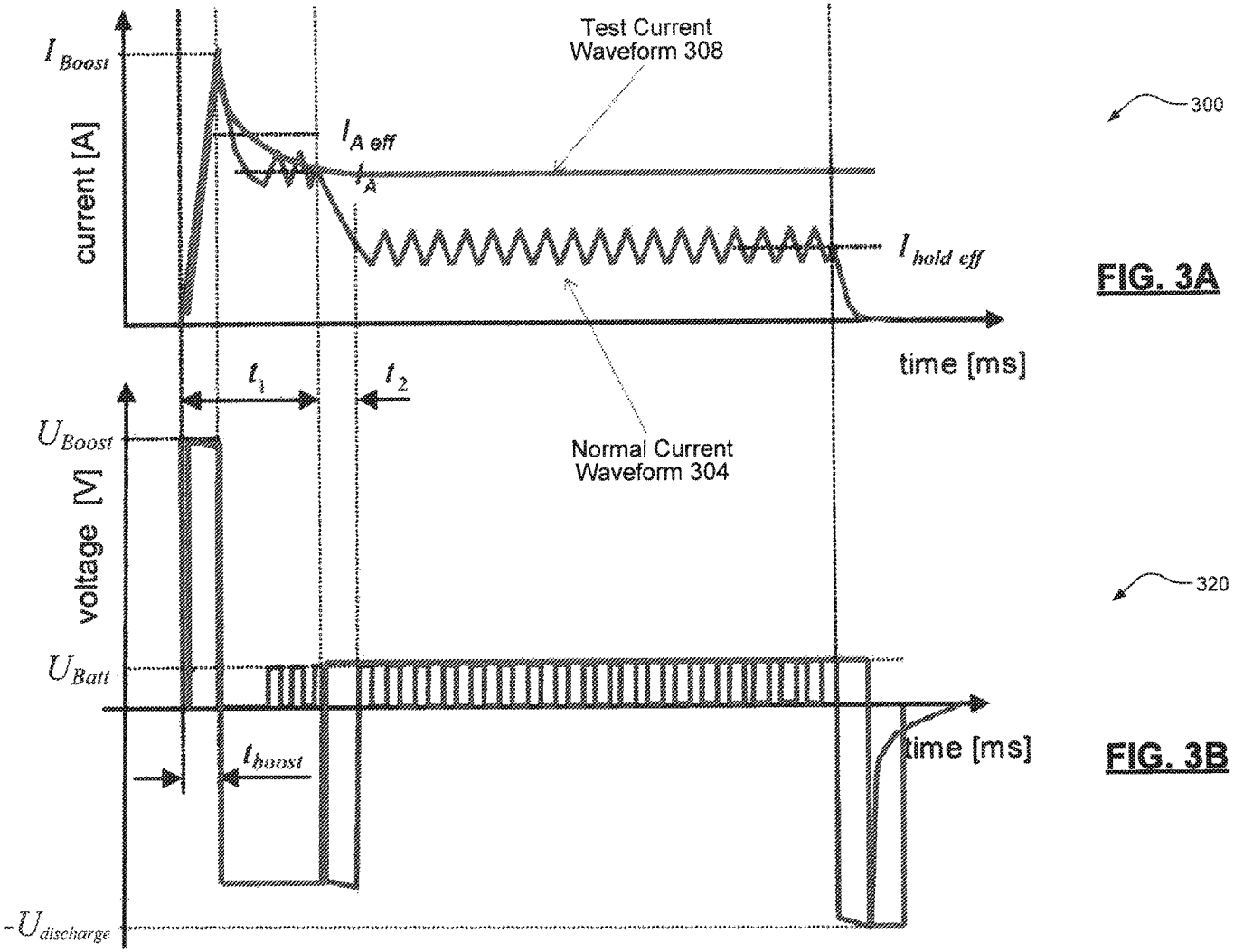
FIGS. 3A-3B are plots of normal and test current and voltage waveforms for supply to an injector coil of a GDI fuel injector according to the principles of the present disclosure.

Referring now to FIGS. 3A-3B, plots 320, 320 of current (in amps, or A) and voltage (in volts, or V) at the injector coil 156 with respect to time (in milliseconds, or ms) are illustrated. FIG. 3A illustrates normal current 304 and test current 308 at the injector coil 156 in response to different driving methods of the injector coil driver 160. Both waveforms ramp up the current to a peak current $I_{Boost}$ during a period $t_{boost}$. In some cases, the injector coil current may never reach this peak current $I_{Boost}$ or may take longer than expected to do so (e.g., due to increased inductance caused by increased injector coil temperature). The normal current waveform 304 then ramps down to current $I_A$ during a remainder of period $t_1$ such to provide an average current $I_{A—eff}$ over the period t1. During a subsequent period t2, the normal current ramps down further and oscillates to provide an effective hold current $I_{hold—eff}$ until the remaining current is finally discharged to complete the fuel injection event. FIG. 3B illustrates the corresponding voltage waveform 308. Voltage is initially increased past a battery voltage $U_{Batt}$ to a boosted voltage $U_{Boost}$. The voltage then drops twice corresponding to the steps down in current and oscillates at the battery voltage $U_{Batt}$ until the remaining current is finally discharged as represented by negative voltage $U_{discharge}$.

Figure 4:
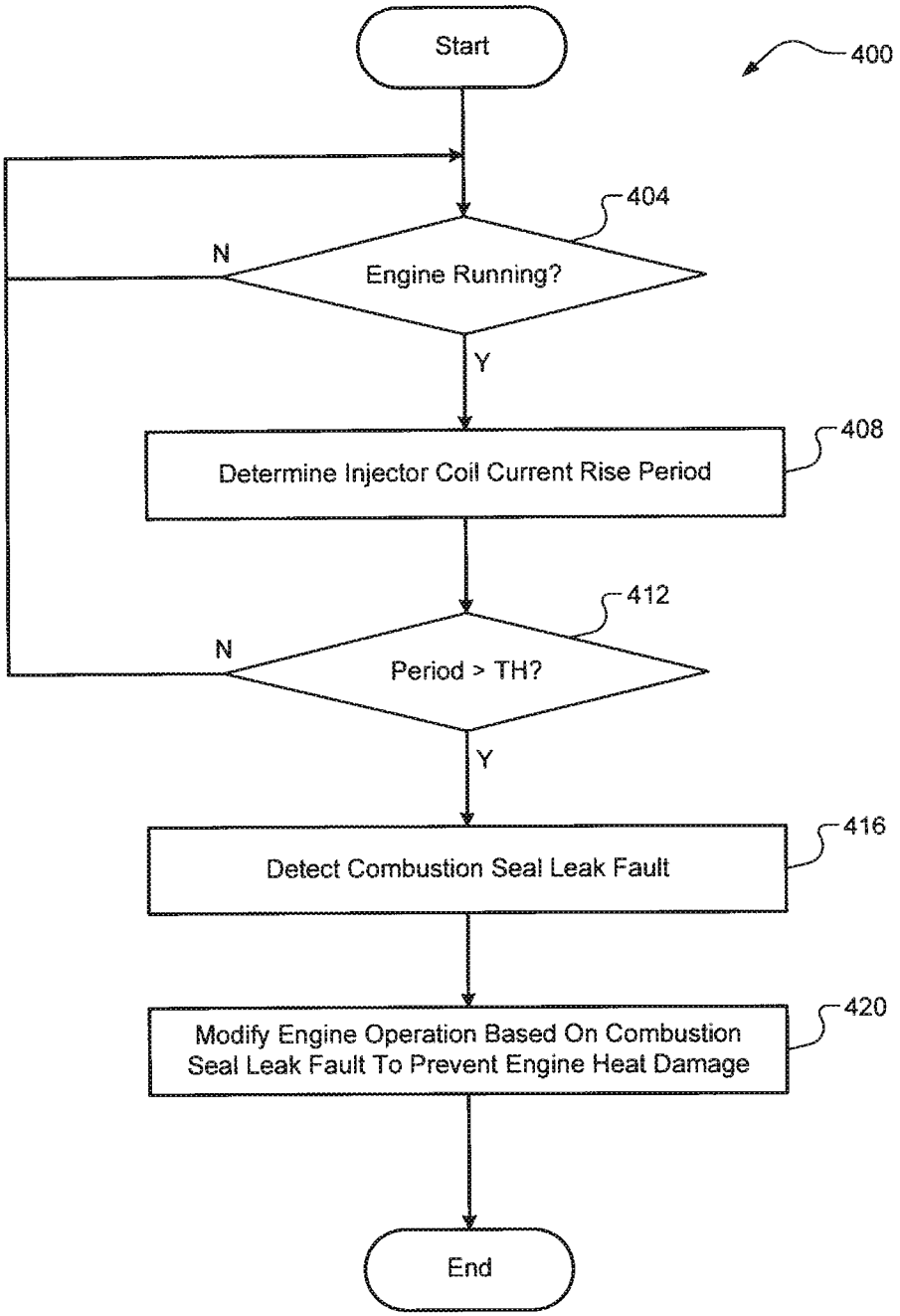
FIG. 4 is a flow diagram of an example non-intrusive, inductance-based method for detecting a combustion seal leak for a GDI fuel injector according to the principles of the present disclosure.

Referring now to FIG. 4, a flow diagram of an example non-intrusive, inductance-based method 400 for diagnosing a leak in the combustion seal 228 is illustrated. At 404, the controller 164 determines whether the engine 104 is running. If true, the method 400 proceeds to 408. Otherwise, the method 400 ends or returns to 404. At 408, the controller 164 monitors a fuel injection event to determine a period (e.g., $T_{Boost}$) for the injector coil current to increase to a peak current. That is, the period corresponds to an inductance of the injector coil 156, which corresponds to the temperature of the injector coil 156. In some cases, this period is indefinite because the injector coil current never reaches the peak current. At 412, the controller 164 determines whether the period is greater than a threshold (TH) corresponding to a predetermined temperature for the injector coil 156. This threshold could be calibrated and application-dependent such that it varies for different configurations of the engine 104. In the case of an indefinite period, there could be another threshold (e.g., $t_{max}$), similar to a timeout. When the injector coil 156 fails to ever reach its peak current before this time threshold is reached, the method 400 proceeds to 416.

As discussed herein, the injector coil temperature increases due to the presence of exhaust gas caused by a leak in the combustion seal 228. In one exemplary implementation, the predetermined temperature is less than a temperature at which plastic component(s) of the engine 104 melt. For example only, the temperature at which the plastic component(s) of the engine 104 melt could be ~230 degrees Celsius (° C.), and the predetermined temperature could be ~200° C. If the determined period is greater than the threshold at 412, the method 400 proceeds to 416. Otherwise, the method 400 ends or returns to 404 or 408. At 416, the controller 164 detects a combustion seal leak fault. At 420, the controller 164, based on the combustion seal leak fault, modifies operation of the engine 104 to prevent potential heat damage to the engine 104 as previously discussed herein. For example, multiple combustion seal leak faults (e.g., greater than a threshold) may need to be detected before the controller 164 modifies operation of the engine 104. In addition, different remedial actions could be taken in response to different numbers of detected combustion seal leak faults. After 420, the method 400 ends or returns to 404.

Figure 5:
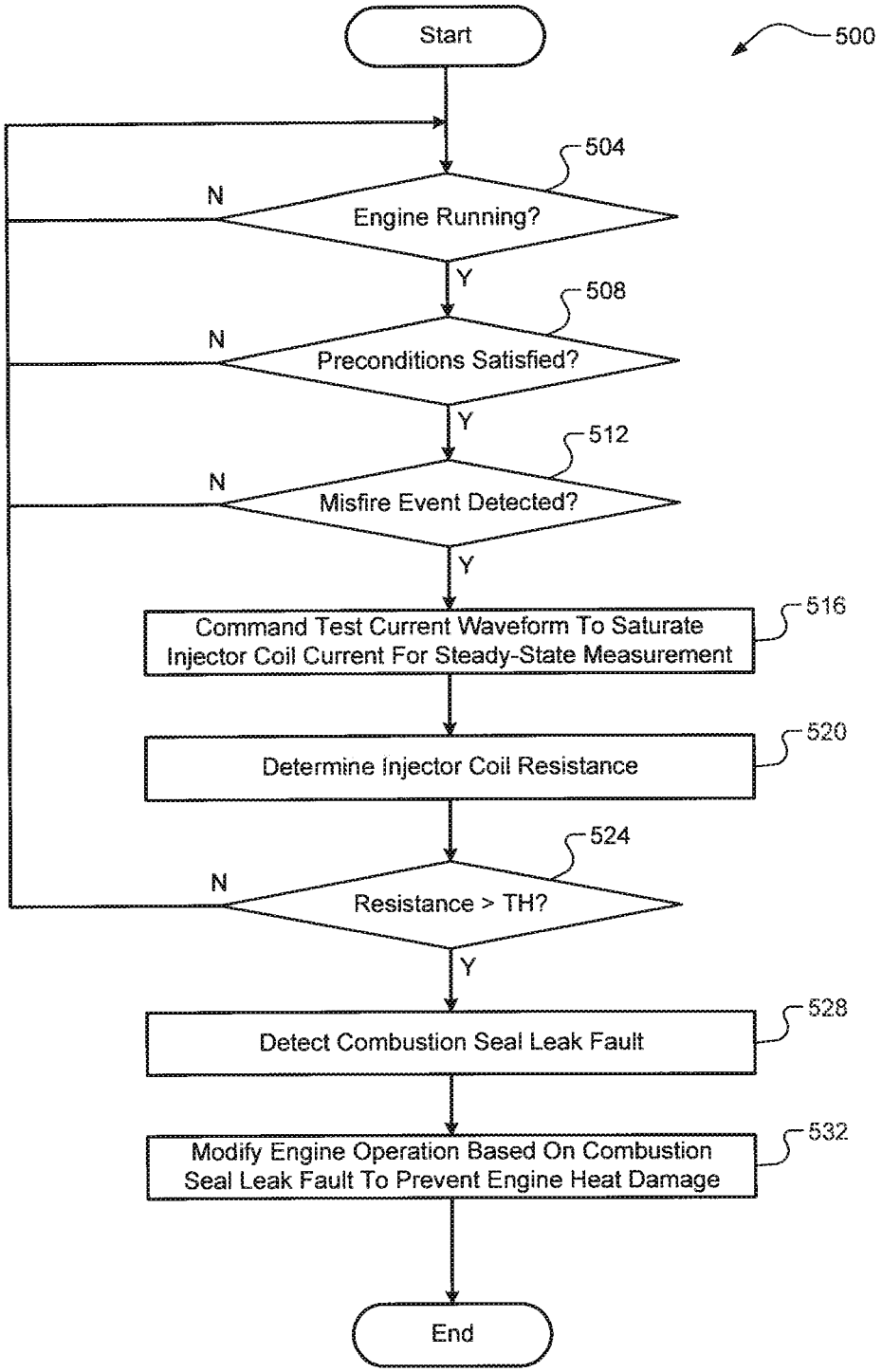
FIG. 5 is a flow diagram of an example intrusive, resistance-based method for detecting a combustion seal leak for a GDI fuel injector according to the principles of the present disclosure.

Referring now to FIG. 5, a flow diagram of an example intrusive, resistance-based method 500 for diagnosing a leak in the combustion seal 228 is illustrated. At 504, the controller 164 detects whether the engine 104 is running. If true, the method 500 proceeds to 508 or 512. Otherwise, the method 500 ends or returns to 504. At optional 508, the controller 164 determines whether a set of preconditions are satisfied. Nonlimiting examples of these preconditions include the fuel rail pressure and fuel injection duration (e.g., based on an engine torque request) satisfying respective minimum thresholds. For example only, the fuel rail pressure threshold could be ~100 bar and the fuel injection duration threshold could be ~5 ms. If these optional preconditions are satisfied, the method 500 proceeds to 512. Otherwise, the method 500 could end or return to 504 or 508.

At 512, the controller 164 determines whether a misfire event has occurred. Any suitable misfire event detection techniques could be utilized. If a misfire event is detected, the method 500 proceeds to 516. Otherwise, the method 500 returns to 504, 508, or 512. At 516, the controller 164 commands the injector coil driver 160 to switch from supplying a normal current waveform (e.g., waveform 304 in FIG. 3A) to supplying a test current waveform (e.g., waveform 308 in FIG. 3A). The supply of this test current waveform causes the injector coil current to saturate, which allows for steady-state measurement or determination of the injector coil voltage/current. This is also the intrusive aspect of this method 500 as the test current waveform may not be an optimal current waveform for the fuel injector 152. At 520, the controller 164 determines the injector coil resistance based on the injector coil voltage/current.

At 524, the controller 164 determines whether the injector coil resistance is greater than a threshold (TH) corresponding to a predetermined temperature for the injector coil 156. This predetermined temperature could be the same temperature discussed above in FIG. 4 or could be different. For example only, a resistance of ~3.5 ohms could correspond to a predetermined temperature of ~200° C. If the determined resistance is greater than the threshold at 524, the method 500 proceeds to 528 where the controller 164 detects a combustion seal leak fault. At 532, the controller, based on the combustion seal leak fault, modifies operation of the engine 104 to prevent potential heat damage to the engine 104 as previously discussed herein. For example, the same or similar remedial actions as discussed above with respect to FIG. 4 could be performed. After 532, the method 500 then ends or returns to 504.

The non-intrusive, inductance-based technique may be preferred to the intrusive, resistance-based technique for a variety of reasons. Being that the resistance-based technique is intrusive, it may cause decreased performance because the fuel injector 152 is not necessarily being operated as desired (e.g., based on a torque request). Rather, the injector coil 156 is forcibly being held at a higher current such that it saturates for better steady-state measurement of current/voltage for resistance determination. The non-intrusive technique, in addition to being able to run continuously while the engine 104 is running (e.g., and not only when preconditions are satisfied and after a misfire event is detected), is also more accurate than the intrusive, resistance-based technique. One benefit of the intrusive, resistance-based technique, however, is that it may require a very simple/inexpensive chipset compared to a more complex/expensive application-specific integrated circuit that may be required to continuously perform the non-intrusive, inductance-based technique.

It will be appreciated that the term "controller" as used herein refers to any suitable control device or set of multiple control devices that is/are configured to perform at least a portion of the techniques of the present disclosure. Non-limiting examples include an ASIC, one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It should also be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A system for a vehicle having a gasoline direct injection (GDI) engine, the system comprising:

an injector coil driver configured to supply a current to an injector coil of a GDI fuel injector of the engine; and a controller configured to:

perform a diagnostic routine for a combustion seal provided between the GDI fuel injector and a combustion chamber of a cylinder of the engine, the diagnostic routine comprising:

determining one of (i) a period for the injector coil current to reach a peak current and (ii) a resistance of the injector coil while the injector coil current is saturated, determining whether the determined period or the determined injector coil resistance is greater than a respective threshold indicative of a predetermined temperature of the injector coil, and when the determined period or the determined injector coil resistance is greater than its respective threshold, detecting a combustion seal leak fault; and based on the combustion seal leak fault, modifying operation of the engine to prevent potential heat damage to the engine.

2. The system of claim 1, wherein the diagnostic routine is a non-intrusive diagnostic routine that continuously determines the period for the injector coil to reach the peak current while the engine is running.

3. The system of claim 1, wherein the diagnostic routine is an intrusive diagnostic routine that is executed in response to detecting a misfire event.

4. The system of claim 3, wherein the intrusive diagnostic routine comprises:

detecting the misfire event of the engine; and in response to detecting the misfire event of the engine, commanding the injector coil driver to switch from supplying a normal current waveform to supplying a different test current waveform that causes the injector coil current to saturate.

5. The system of claim 4, wherein the test current waveform allows the injector coil current to saturate to allow for steady-state measurement of its current and voltage by the controller, and wherein the controller determines the resistance of the injector coil based on its measured current and voltage.

6. The system of claim 5, wherein the controller is further configured to detect a set of preconditions before performing the intrusive diagnostic routine, the set of preconditions including fuel injection duration and fuel rail pressure being greater than respective minimum thresholds.

7. The system of claim 1, wherein the controller is configured to modify operation of the engine by commanding a limp home mode where torque output of the engine is reduced.

8. The system of claim 1, wherein the controller is configured to modify operation of the engine by disabling the cylinder associated with the combustion seal leak fault.

9. The system of claim 1, wherein the controller is configured to modify operation of the engine by limiting power output of the cylinder associated with the combustion seal leak fault.

10. The system of claim 1, wherein the predetermined temperature is less than a temperature at which a plastic portion of the GDI engine melts, wherein the plastic portion of the GDI engine is one of a body of the GDI fuel injector, a valve cover, and a wire harness.

11. A method for diagnosing a leak of a combustion seal provided between a gasoline direct injection (GDI) fuel injector and a combustion chamber of a cylinder of a GDI engine of a vehicle, the method comprising:

controlling, by a controller of the engine, an injector coil driver that is configured to supply a current to an injector coil of a GDI fuel injector of the engine;

performing, by the controller, a diagnostic routine for a combustion seal provided between the GDI fuel injector and a combustion chamber of a cylinder of the engine, the diagnostic routine comprising:

determining one of (i) a period for the injector coil current to reach a peak current and (ii) a resistance of the injector coil while the injector coil current is saturated, determining whether the determined period or the determined injector coil resistance is greater than a respective threshold indicative of a predetermined temperature of the injector coil, and when the determined period or the determined injector coil resistance is greater than its respective threshold, detecting a combustion seal leak fault; and based on the combustion seal leak fault, modifying, by the controller, operation of the engine to prevent potential heat damage to the engine.

12. The method of claim 11, wherein the diagnostic routine is a non-intrusive diagnostic routine that continuously determines the period for the injector coil to reach the peak current while the engine is running.

13. The method of claim 11, wherein the diagnostic routine is an intrusive diagnostic routine that is executed in response to detecting a misfire event.

14. The method of claim 13, wherein the intrusive diagnostic routine comprises:

detecting, by the controller, the misfire event of the engine; and in response to detecting the misfire event of the engine, commanding, by the controller, the injector coil driver to switch from supplying a normal current waveform to supplying a different test current waveform that causes the injector coil current to saturate.

15. The method of claim 14, wherein the test current waveform allows the injector coil current to saturate to allow for steady-state measurement of its current and voltage by the controller, and wherein the controller determines the resistance of the injector coil based on its measured current and voltage.

16. The method of claim 15, further comprising detecting, by the controller, a set of preconditions before performing the intrusive diagnostic routine, the set of preconditions including fuel injection duration and fuel rail pressure being greater than respective minimum thresholds.

17. The method of claim 11, wherein modifying operation of the engine includes commanding, by the controller, a limp home mode where torque output of the engine is reduced.

18. The method of claim 11, wherein modifying operation of the engine includes disabling, by the controller, the cylinder associated with the combustion seal leak fault.

19. The method of claim 11, wherein modifying operation of the engine includes limiting, by the controller, power output of the cylinder associated with the combustion seal leak fault.

20. The method of claim 11, wherein the predetermined temperature is less than a temperature at which a plastic portion of the GDI engine melts, wherein the plastic portion of the GDI engine is one of a body of the GDI fuel injector, a valve cover, and a wire harness.

* * * * *